US008378762B2

(12) United States Patent
Kushta

(10) Patent No.: US 8,378,762 B2
(45) Date of Patent: Feb. 19, 2013

(54) COMPACT FILTERING STRUCTURE

(75) Inventor: Taras Kushta, Tokyo (JP)

(73) Assignee: NEC Corporation, Tokyo (JP)

( * ) Notice: Subject to any disclaimer, the term of this patent is extended or adjusted under 35 U.S.C. 154(b) by 469 days.

(21) Appl. No.: 12/529,382

(22) PCT Filed: Mar. 2, 2007

(86) PCT No.: PCT/JP2007/054604

§ 371 (c)(1),
(2), (4) Date: Oct. 6, 2009

(87) PCT Pub. No.: WO2008/108003

PCT Pub. Date: Sep. 12, 2008

(65) Prior Publication Data

US 2010/0052821 A1 Mar. 4, 2010

(51) Int. Cl.
*H01P 1/203* (2006.01)

(52) U.S. Cl. ..... 333/204

(58) Field of Classification Search ..... 333/204, 333/238, 246, 219, 161, 202, 203, 205, 235
See application file for complete search history.

(56) References Cited

U.S. PATENT DOCUMENTS

| | | | | |
|---|---|---|---|---|
| 5,621,366 | A * | 4/1997 | Gu et al. | 333/204 |
| 5,748,057 | A | 5/1998 | De Los Santos | |
| 7,157,992 | B2 * | 1/2007 | McKinzie, III | 333/219 |
| 2001/0040490 | A1 * | 11/2001 | Tanaka | 333/204 |
| 2004/0239451 | A1 * | 12/2004 | Ramprasad et al. | 333/202 |
| 2006/0255876 | A1 | 11/2006 | Kushta et al. | |

FOREIGN PATENT DOCUMENTS

| | | | |
|---|---|---|---|
| JP | H01143403 | A | 6/1989 |
| JP | 2-26106 | A | 1/1990 |
| JP | 2001111302 | A | 4/2001 |
| JP | 2003304113 | A | 10/2003 |
| JP | 2006246189 | A | 9/2006 |
| JP | 2006253929 | A | 9/2006 |
| JP | 2006295792 | A | 10/2006 |
| JP | 2007005614 | A | 1/2007 |
| WO | 2004107830 | A1 | 12/2004 |

OTHER PUBLICATIONS

International Search Report for PCT/JP2007/054604 mailed Jun. 19, 2007.
Japanese Office Action for JP2009-535519 mailed on Jul. 11, 2012.

* cited by examiner

*Primary Examiner* — Benny Lee
*Assistant Examiner* — Gerald Stevens

(57) ABSTRACT

An electromagnetic band gap (EGB) structure includes a substrate made of an isolating material. A plurality of identical planar transmission line segments are formed one under another in conductor layers embedded in the substrate. Vertical transitions connect one by one the plurality of planar transmission line segments. Adjacent ones of the vertical transitions are equally spaced on a predetermined distance in a direction parallel to the transmission line segments, thereby the vertical transitions serve as periodical inclusions forming the EBG structure.

5 Claims, 19 Drawing Sheets

COMPACT FILTERING STRUCTURE

This application is the National Phase of PCT/JP2007/054604, filed Mar. 2, 2007.

TECHNICAL FIELD

The present invention relates to a structure providing an electromagnetic band gap (EBG) effect and a compact filter based on the structure.

BACKGROUND ART

Modern communications and computer technologies greatly stimulate development of compact devices and systems. In particular, it can be related to filters, managing frequency responses, which are indispensable components in electronic systems including wire and wireless devices. Artificially-created periodicity in arrangement of same elements is one of the most fundamental approaches to design new materials and new types of microwave and optical components.

In particular, such approach is realized in forming an Electromagnetic Band Gap (EBG) structure (known also as Photonic Band Gap (PBG) structures, or Photonic Crystals, or Electromagnetic Crystals). In particular, these structures demonstrate an extremely-high attraction as filters because a band gap can be used to stop effectively signal transmission and a region out of the band gap can be applied for the pass of signals. Also, a defect in the EBG structure can lead to filters showing high Q (quality-factor) pass characteristics within the band gap.

Printed board technologies are widely applied as a cost-effective approach to develop different types of electronic equipment. Various planar transmission line structures based on these technologies are applied to obtain band gap effect and, as results, to develop different types of filtering components. However, the EBG structure can be considerably extended in dimensions, because a number of periodic cells to achieve a high-quality EBG effect can be large enough. This is a significant limitation of application of the EBG structure in actual devices, especially, at microwaves.

The application of the EBG concept to design compact components including filters is strongly limited, especially at microwave, because a band gap effect occurs due to periodical perturbations in a transmission medium. In this case, a lattice constant of such medium can be approximately equal to a half of the wavelength in the medium. As a result, dimensions of the structure providing the band gap effect in a planar periodical transmission line formed in a substrate can be considerably larger than the operating wavelength and cannot be acceptable for an electronic device. Also, the EBG structure based on a defected ground surface in a substrate can lead to a considerable increase of radiation (leakage losses) from the structures that can excite EMI problems in a designing device.

In conjunction with the above description, an antenna apparatus is disclosed in Japanese Laid Open Patent application (JP-P2003-304113A). In this conventional example, a monopole antenna excited through a coaxial line is provided at a center portion of a metal plate, on whose surface, a dielectric plate is formed. Thereby, the monopole antenna resonates at a specific frequency to the plate as a first substrate. Small regular hexagonal shaped metal plates are arranged in a 2-dimensional array in a constant interval on the surface of the dielectric plate in an external circumferential portion. A contact is formed to connect between the small metal plate and the metal plate, and an HIP substrate is formed as a second substrate which has a band gap to prevent propagation of electromagnetic wave of the above-mentioned specific frequency. Thus, the radiation of the electromagnetic wave of the specific frequency excited by the monopole antenna from a back side is restrained by the second substrate. In this way, the radiation from the back surface of the plate board is suppressed and enough antenna gain can be obtained to attain the resonance of the antenna.

Also, a connection structure of a strip line is disclosed in Japanese Laid Open Patent application (JP-P2006-246189A). In this conventional example, the connection structure of the strip line connects a first strip line and a second strip line, which are formed in different layers of a dielectric substrate, in a laminate direction through a connection section. A first removal section is formed where a grounded conductor pattern is removed, such that a strip conductor pattern connecting conductor constituting the connection section by connecting a tip portion of the strip conductor pattern of the first strip line and a tip portion of the strip conductor pattern of the second strip line, can penetrate without electrical contact with the grounded conductor pattern which is provided for the dielectric substrate between the first strip line and the second strip line. Second removal sections where the grounded conductor pattern is removed are provided periodically or approximately periodically for the grounded conductor of the first strip line and the grounded conductor of the second strip line.

Also, EBG material is disclosed in Japanese Laid Open Patent Application (JP-P2006-253929A). In this conventional example, a plurality of inductance elements are formed on the front surface of a first substrate. A second substrate has a dielectric substance provided on a rear surface side of the first substrate, and a conductor plate arranged on the opposite side to the first substrate with respect to the dielectric substance. A plurality of small metal plates are arranged above the plurality of inductance elements to be equally distanced to each other. The plurality of small metal plates are connected with the plurality of inductance elements by a plurality of connecting sections, respectively.

DISCLOSURE OF INVENTION

It is an object of the present invention to provide a compact EBG structure by use of multi-layer substrate architecture including a planar transmission line and a via-interconnection.

It is another object to provide an EBG structure with low radiation (leakage losses).

In an aspect of the present invention, an electromagnetic band gap (EGB) structure includes a substrate made of an isolating material. A plurality of identical planar transmission line segments are formed one under another in conductor layers embedded in the substrate. Vertical transitions connect one by one the plurality of planar transmission line segments. Adjacent ones of the vertical transitions are equally spaced on a predetermined distance in a direction parallel to the transmission line segments, thereby the vertical transitions serve as periodical inclusions forming the EBG structure.

Here, the plurality of planar transmission line segments may be formed as segments of a strip line. Also, the plurality of planar transmission line segments may be formed as segments of a coplanar waveguide.

Also, the vertical transitions may be formed as a signal via isolated from ground strips of the plurality of planar transmission line segments by a clearance hole.

Also, the vertical transitions may be formed as a signal via isolated from ground strips of the plurality of planar transmission line segments by a clearance hole, and the signal via may be surrounded by ground vias connected to the ground strips of the plurality of planar transmission line segments.

In another aspect of the present invention, a filter includes a substrate made of an isolating material. A plurality of identical planar transmission line segments are formed one under another by use of conductor layers embedded in the substrate and arranged in a predetermined manner in a direction perpendicular to the conductor layers. Vertical transitions connect one by one the plurality of transmission line segments, wherein adjacent the vertical transitions are equally spaced on a predetermined distance in a direction parallel to the plurality of transmission line segments, thereby the vertical transitions serve as periodical inclusions providing an electromagnetic band gap effect, and forming conjointly with the plurality of planar transmission line segments of an electromagnetic band gap (EBG) structure. Terminals are connected in a predetermined method to top and bottom ones of the plurality of transmission line segments of the EBG structure.

Here, the substrate may be made of a high-permittivity low-loss material for which relative permittivity is larger than nine, and loss tangent is lower than 0.005 in predetermined frequency band.

Also, the plurality of planar transmission line segments may be formed as segments of a strip line.

Also, the plurality of planar transmission line segments may be formed as segments of a coplanar waveguide.

Also, a number of the plurality of planar transmission line segments may be defined as providing a predetermined level of insertion losses in a stop band.

Also, a control of stop band and pass band may be provided by the predetermined distance separating adjacent the vertical transitions.

Also, the vertical transitions may be formed as a signal via isolated from ground strips of the plurality of planar transmission line segments by a clearance hole.

In addition, the vertical transitions may be formed as a signal via isolated from ground strips of the plurality of planar transmission line segments by a clearance hole, and the signal via may be surrounded by ground vias connected to ground strips of the plurality of planar transmission line segments.

Also, the plurality of transmission line segments and the vertical transitions may form a number of the EBG structures in the substrate so that a length of the plurality of transmission line segments for each the EBG structure is defined in a predetermined manner.

Also, the plurality of transmission line segments and the vertical transitions may form a number of the EBG structures in the substrate so that a length of the plurality of transmission line segments and a distance separating adjacent the vertical transitions in each the EBG structure is defined in a predetermined manner.

Also, a defect may be formed in the EBG structure, thereby providing a pass band within a stop band. In this case, the defect may be formed by a planar transmission line structure of the plurality of planar transmission line segments. Also, the defect may be formed by the planar transmission line structure having a predetermined length.

Also, the defect may be formed by the planar transmission line structure filled with a predetermined material.

Also, the defect may be formed by the planar transmission line structure having a predetermined length and filled with a predetermined material.

Also, the defect may be formed by a distance between two of the vertical transitions connected to a planar transmission line structure of the plurality of planar transmission line segments.

Also, the defect may be formed by a distance between two of the vertical transitions connected to a planar transmission line structure of the plurality of planar transmission line segments and the planar transmission line structure.

BEST MODE FOR CARRYING OUT THE INVENTION

Figure 1A:
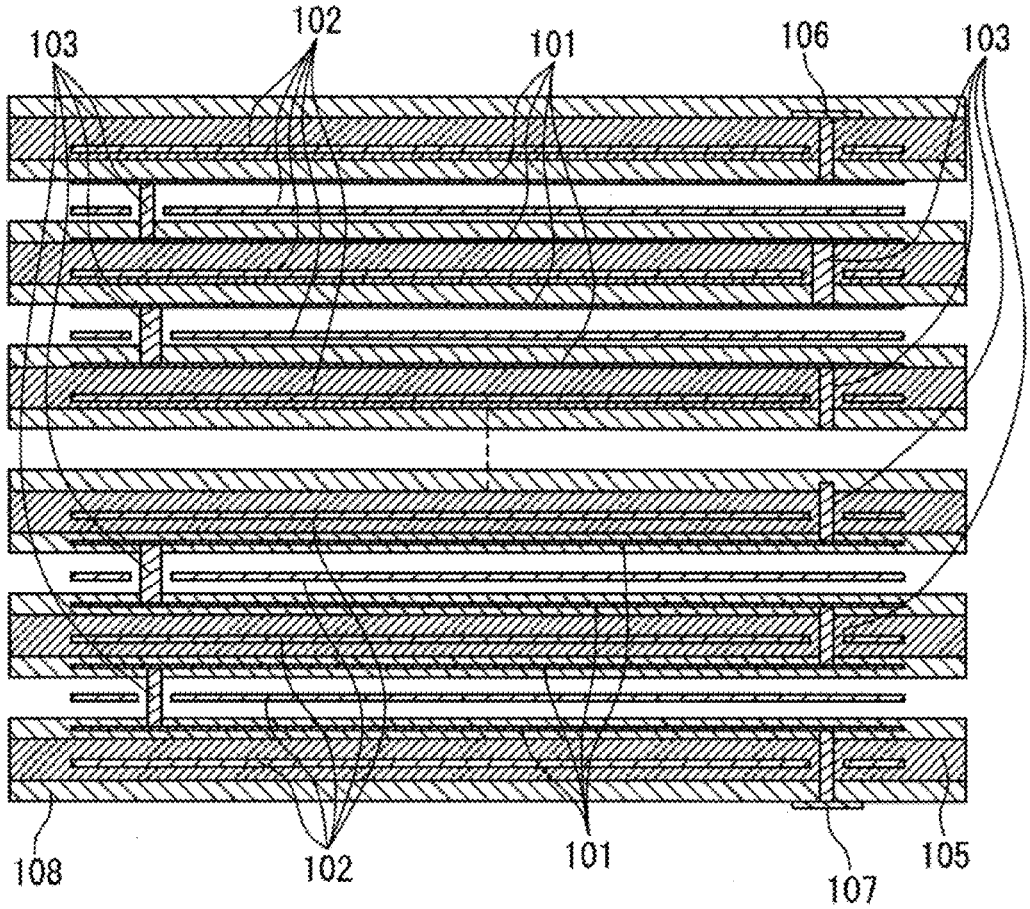
FIG. 1A is a cross sectional view showing a filter based on an EBG structure formed in a multi-layer substrate according to an embodiment of the present invention.
Figure 1B:
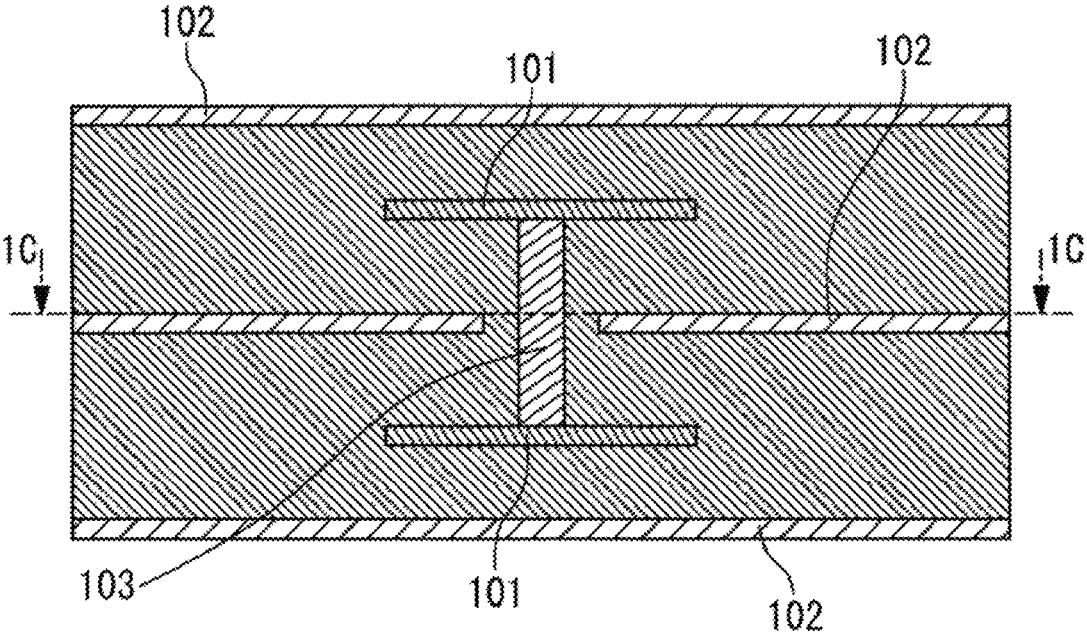
FIG. 1B is a cross sectional view showing two transmission line segments connected by a via structure in the EBG structure.
Figure 1C:
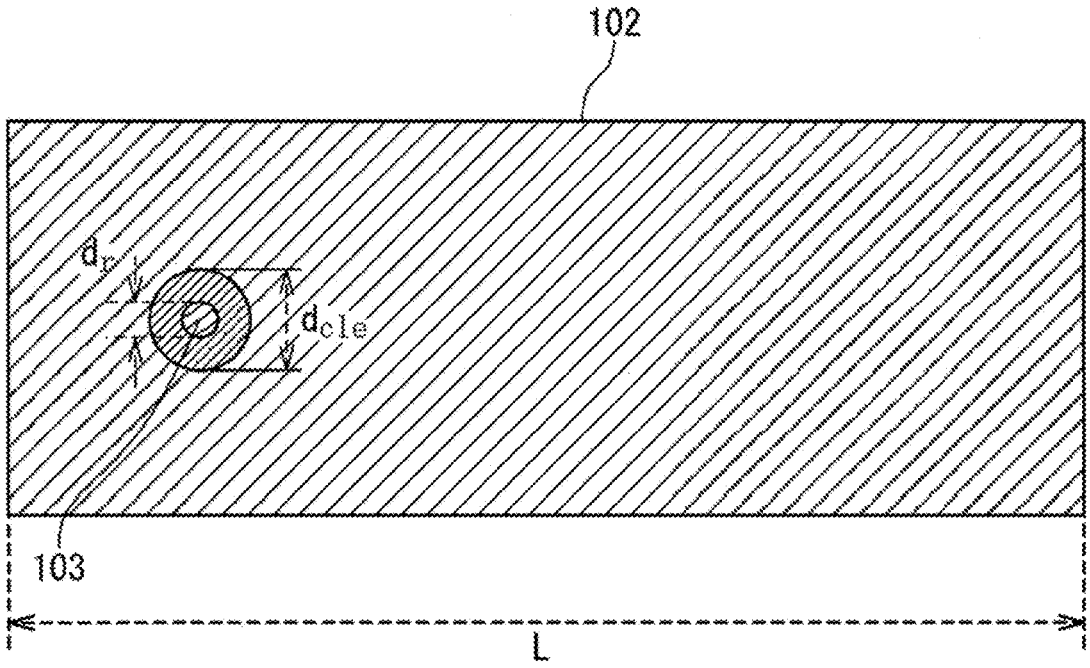
FIG. 1C is a cross sectional view showing a ground strip in the EBG structure.
Figure 1D:
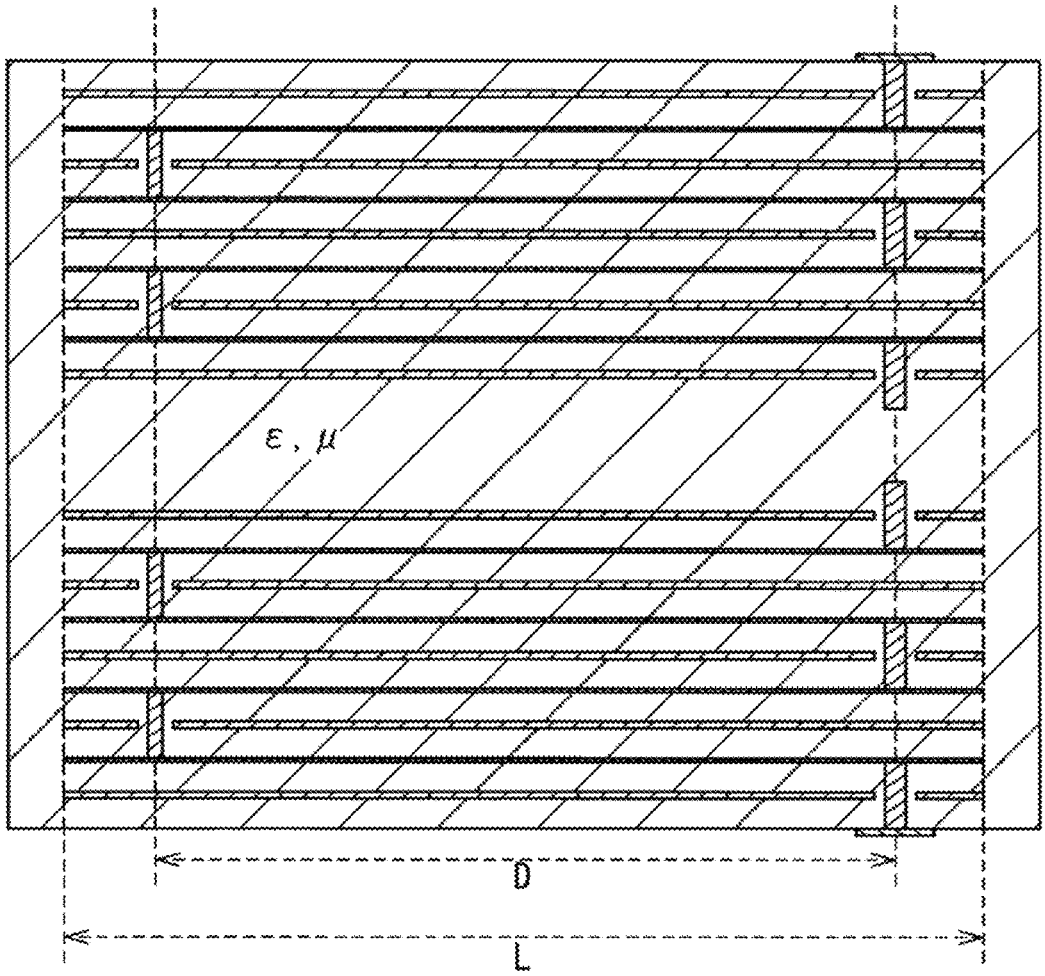
FIG. 1D is a cross sectional view showing the filter to indicate its dimension notation.
Figure 1E:
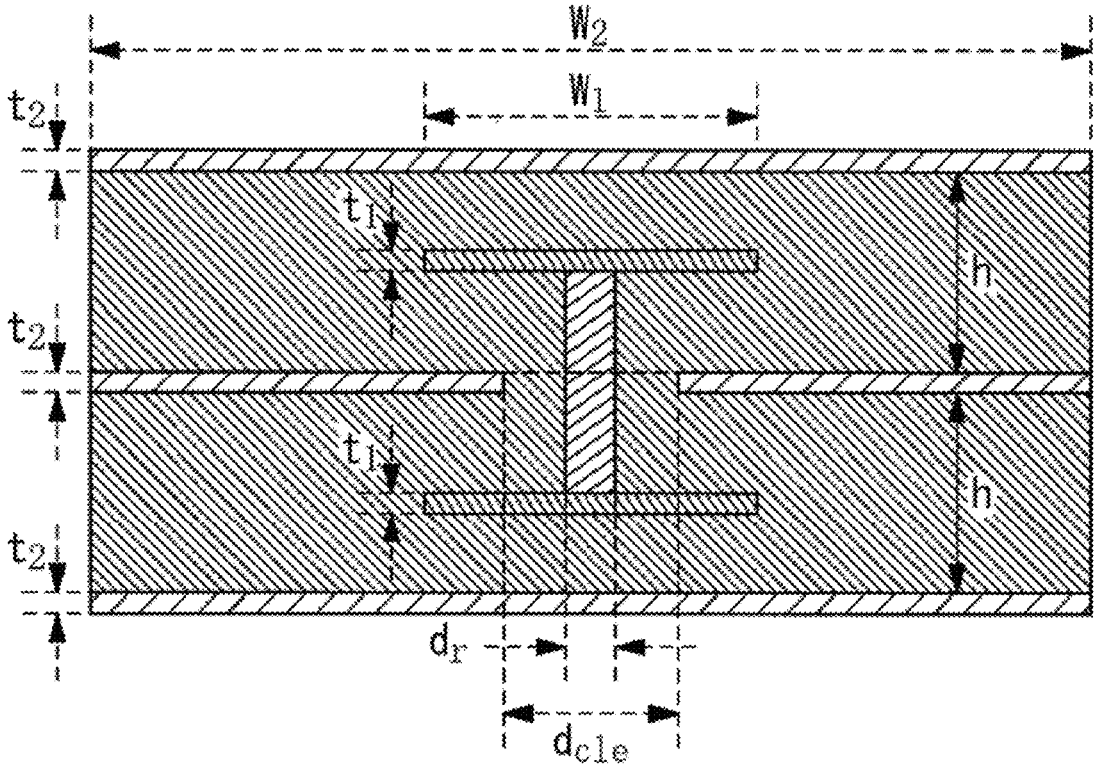
FIG. 1E is a cross sectional view showing two transmission line segments connected by a via-structure of the EBG structure to indicate their dimension notation.

The following description of preferred embodiments is directed to a number of electromagnetic band gap (EBG) structures and filters based on these EBG structures in a multi-layer substrate but it should be well understood that this description should not be viewed as narrowing the claims which are presented here.

In the present invention, one-dimensional (1-D) EBG structures formed in a multi-layer substrate using a planar transmission line and a via-structure are proposed. The planar transmission line includes same segments formed one under another in the multi-layer substrate. These segments are connected by the via-structures in such way that a planar-transmission-line-to-via transitions are separated one from another by a same distance. A fundamental mode of the planar transmission line propagating from a top transmission line segment to a bottom transmission line segment is periodically perturbed by the transition and, as a result, the EBG effect can be achieved.

As an embodiment of the present invention, in FIGS. 1A to 1E, the EBG structure in a multi-layer substrate 108 is presented. This structure is formed by transmission line segments including signal strips 101 disposed between ground strips 102 and via-structures 103 connecting the signal strips is 101. The strip line segments have a same length L, and adjacent via-structures 103 are spaced by a same distance D. The transmission-line-via-structure is embedded in an isolating material 105 characterized by constitutive parameters, •=•'−j•" and •=•'−j•". Electromagnetic wave (for example, TEM mode) propagates between input/output ports 106 and 107 and is periodically perturbed at transmission-line-via-structure-transmission-line transitions. Due to such periodical perturbations, an EBG effect can be obtained under predetermined conditions.

A numerical example of the EBG structure designed according to FIG. 1 is supposed. The dimensions of the structures in this example are as following: a signal strip width $W_1$=0.5 mm, ground plane width $W_2$=4 mm, strip thickness $t_1$=0.01 mm, ground plane thickness $t_2$=0.01 mm, via diameter $d_r$=0.2 mm, clearance hole diameter $d_{cle}$=0.45 mm, component length L=4.85 mm, distance between centers of adjacent vias D=3.45 mm, and h=0.08 mm. This periodical structure has been embedded in a dielectric material characterized a high relative permittivity of •'=70 and a loss tangent tan •=•"/•'=0.005. Such high relative permittivity can lead to more compact dimensions of the EBG structure. A number of signal strip segments arranged in the vertical direction is n=10. This means that the concerned periodic structure has ten cells. It is clear that a level of insertion loss at stop band is dependent on the number of periodic cells. If the number of periodic cells increases, the insertion losses at the stop band are also increased. Thus, controlling this number one can obtain a predetermined level of insertion losses in the stop band.

Figure 2:
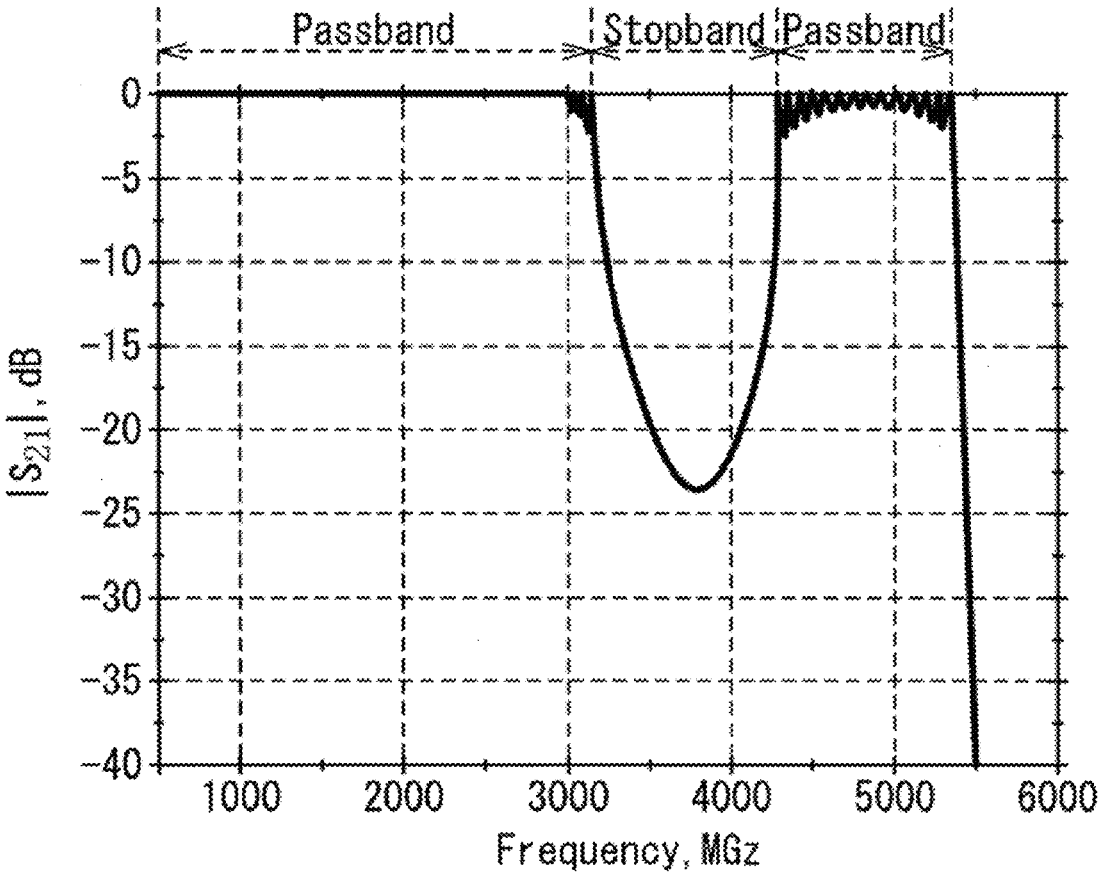
FIG. 2 is a graph showing $S_{21}$-parameter which demonstrates stop band and pass band of the EBG structure.

In FIG. 2, the insertion loss ($|S_{21}|$-parameter) of the structure is presented. These numerical data have been obtained by use of the finite-difference time-domain (FDTD) algorithm which is one of the most accurate numerical methods in three-dimensional simulations. As follows from FIG. 2, one can recognize such areas which can be used to develop filtering components: First band from the DC area to the frequency of about 3.2 GHz can be used for a specific band pass filter; Second band from about 3.2 GHz to about 4.3 GHz can be applied to design a band stop filter; Third area extending from about 4.3 GHz to about 5.3 GHz demonstrates characteristics which are suitable for development of a band pass filter. It should be noted that the sequence of band stop and band pass properties will be continued at higher frequencies for the structure. Thus, the structure shown in FIG. 1 demonstrates clearly-expressed EBG effect. It is important to note that the center frequency of the stop band can be defined according to well-known Bragg reflection condition used for a periodic structure. This condition can be written as following:

$$f_c = \frac{cm}{2a\sqrt{\varepsilon}} \tag{1}$$

where $f_c$ is the center frequency of the stop band, c is velocity of light in the free space, • is a relative permittivity of the surrounding medium (in this case, substrate isolating material), a is the period of the structure, and m is an ordinal number of the stop bands.

Figure 3:
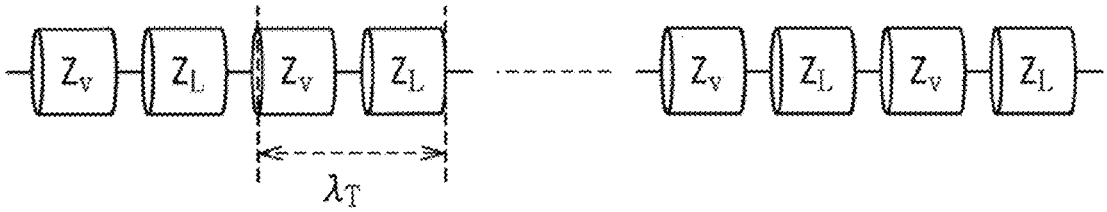
FIG. 3 is a diagram showing a physical mechanism forming EBG effect.

In FIG. 3, the EBG structure is presented as an alternate sequence of transmission line segments with characteristic impedance $Z_v$ and via-structure with the characteristic impedance $Z_v$. One cell of periodic structure is defined as one transmission line segment and one via-structure. The equation (1) can be also represented as the following equation (2)

$$a = \frac{\lambda_T}{2} \tag{2}$$

where $•_T$ is the wavelength in the propagating mode in the surrounding medium. Because the length of the via-structure is much smaller than the length of transmission line segment, the period of the concerned structure can be approximately defined as equal to the length of the signal strip segment:

$$a \approx L \tag{3}$$

For the numerical example shown in FIG. 2, the center frequency of the first stop band defined according to the equation (1) and the approximate equation (3) is equal to 3.7 GHz that is in a good agreement with data described with reference to FIG. 2.

Figure 4A:
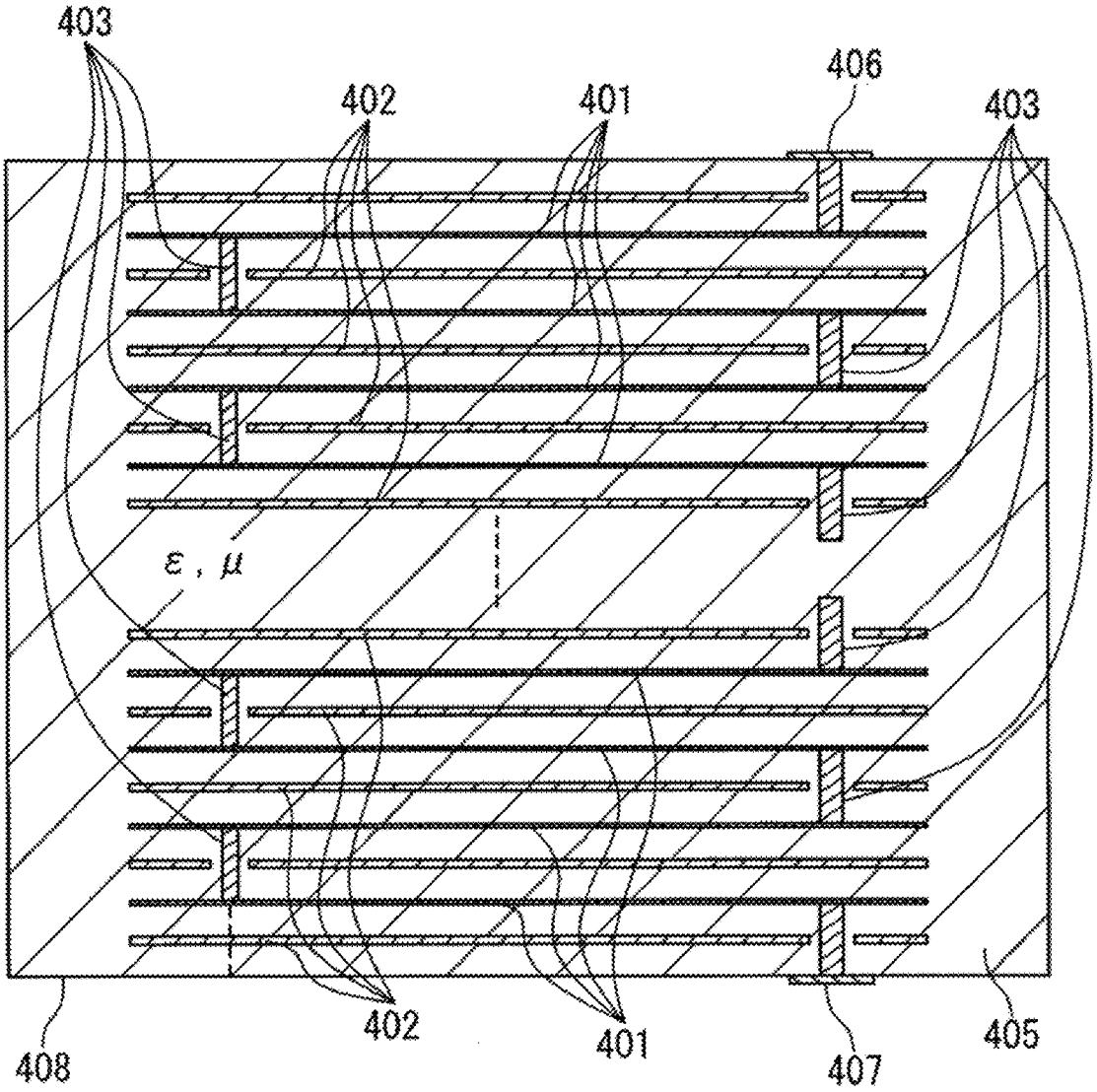
FIG. 4A is a cross sectional view showing the filter based on the EBG structure in a multi-layer substrate according to another embodiment of the present invention.
Figure 4B:
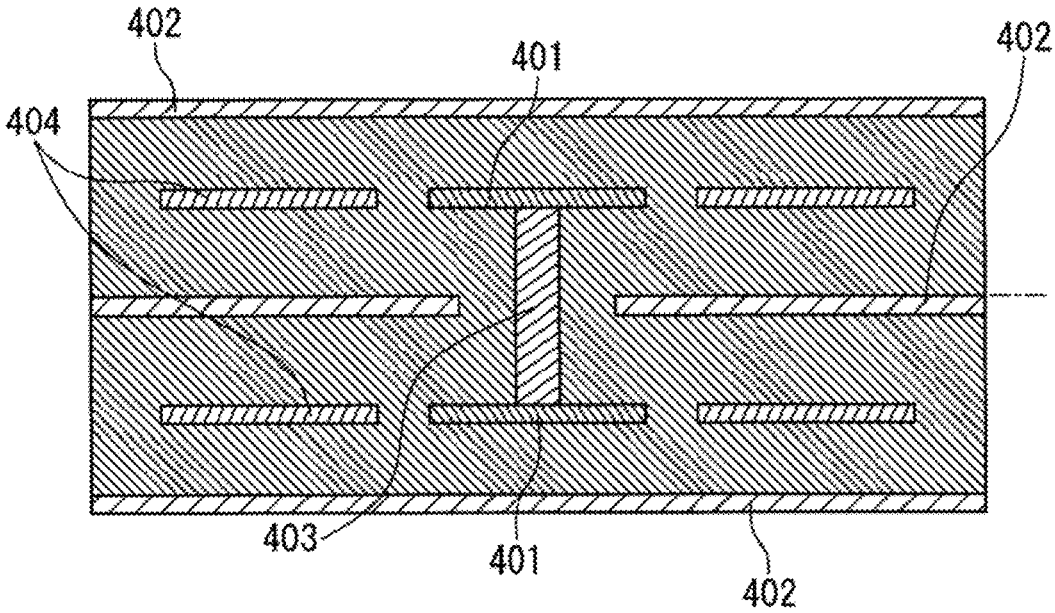
FIG. 4B is a cross sectional view showing two transmission line segments connected by a via structure in the filter shown in FIG. 4A.

It is understandable that, in a capacity of the planar transmission line, different types of wave guiding structures can be used. In FIGS. 4A and 4B, another EBG structure in which a planar transmission line is formed as a coplanar waveguide is shown. In FIG. 4B, a cross-sectional view of two transmission line segments connected by a via-structure in this EBG structure is presented. It should be noted that the coplanar waveguide is formed by a signal strip 401 and ground strips 404 disposed between ground strips 402.

Figure 5:
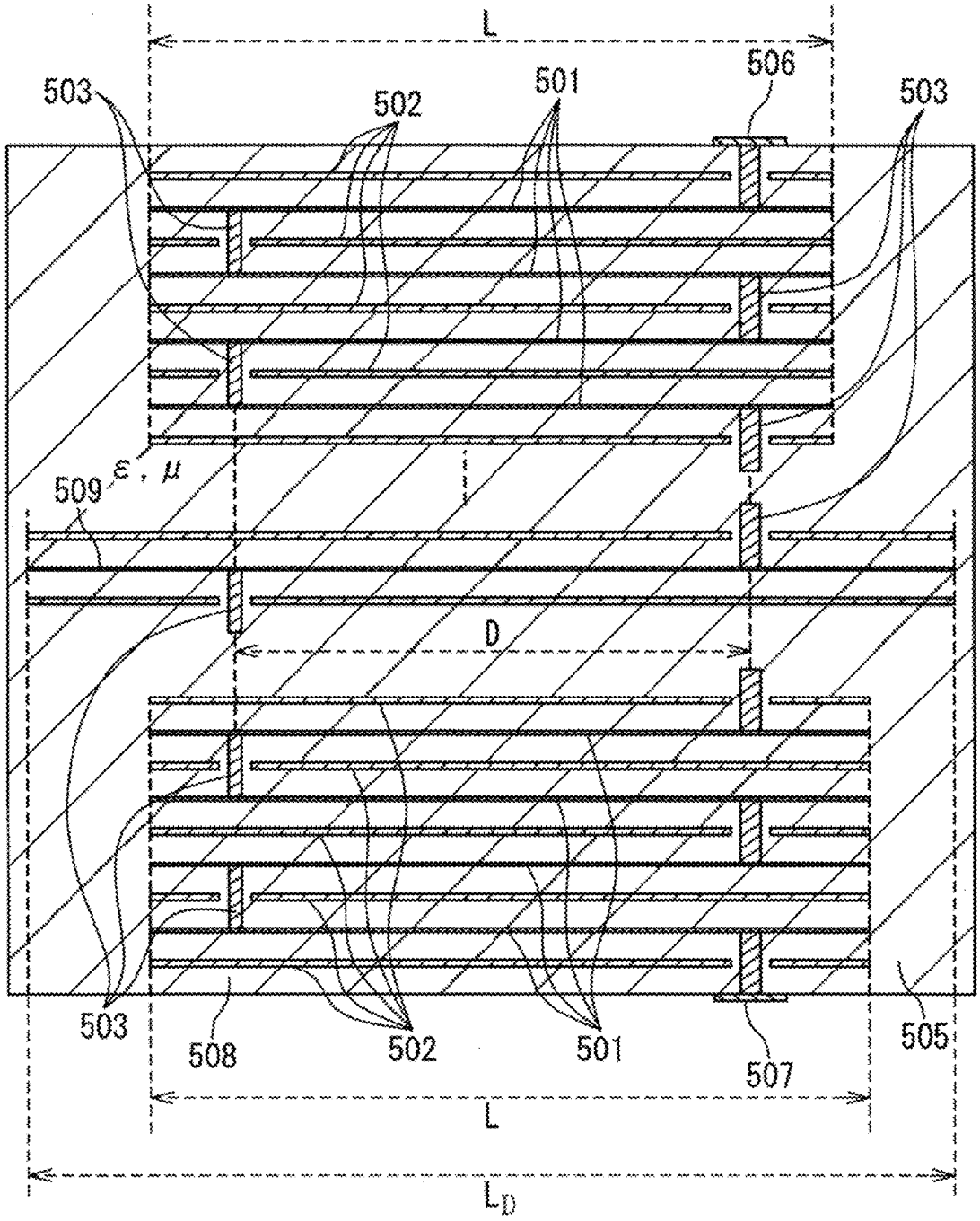
FIG. 5 is a cross sectional view showing the filter based on the EBG structure with a defect.

Another embodiment of the present invention is presented in FIG. 5, in which an EBG structure with a defect is demonstrated. This defect is introduced by one cell disposed between two assemblies of the same periodic cells. It should be noted that each cell of the EBG structure formed from the transmission line segment and the via-structure, is embedded in a substrate isolating material. Thus, the periodic cells of the EBG structure are formed from ground strips 502 and signal strips 501 connected by via-structures 503. The length of each strip line segment is L and the distance between two adjacent via-structures connecting the strip line segments is D. The defect in the concerned EBG structure is introduced by a strip line segment including a signal strip 509 between ground strips 510 and having the length $L_D$. At the same time, the distance between two adjacent via-structures connected to the signal strip providing the defect is the same as in the periodic cells. It should be noted that that the multi-layer substrate 508 is filled with an isolating material 505 with a relative permittivity • and relative permeability •.

Figure 6:
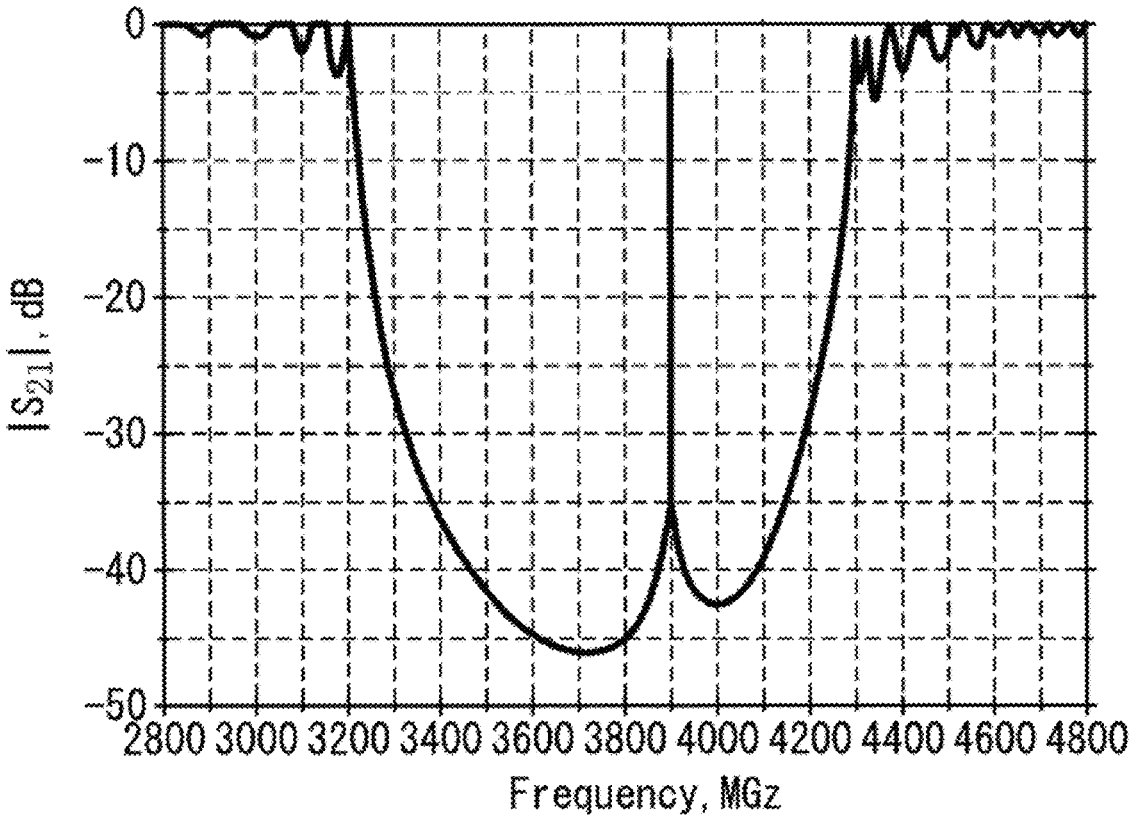
FIG. 6 is a graph showing the $S_{21}$-parameter which demonstrates a narrow pass band within a stop band in the EBG structure with the defect as shown in FIG. 5.
Figure 7:
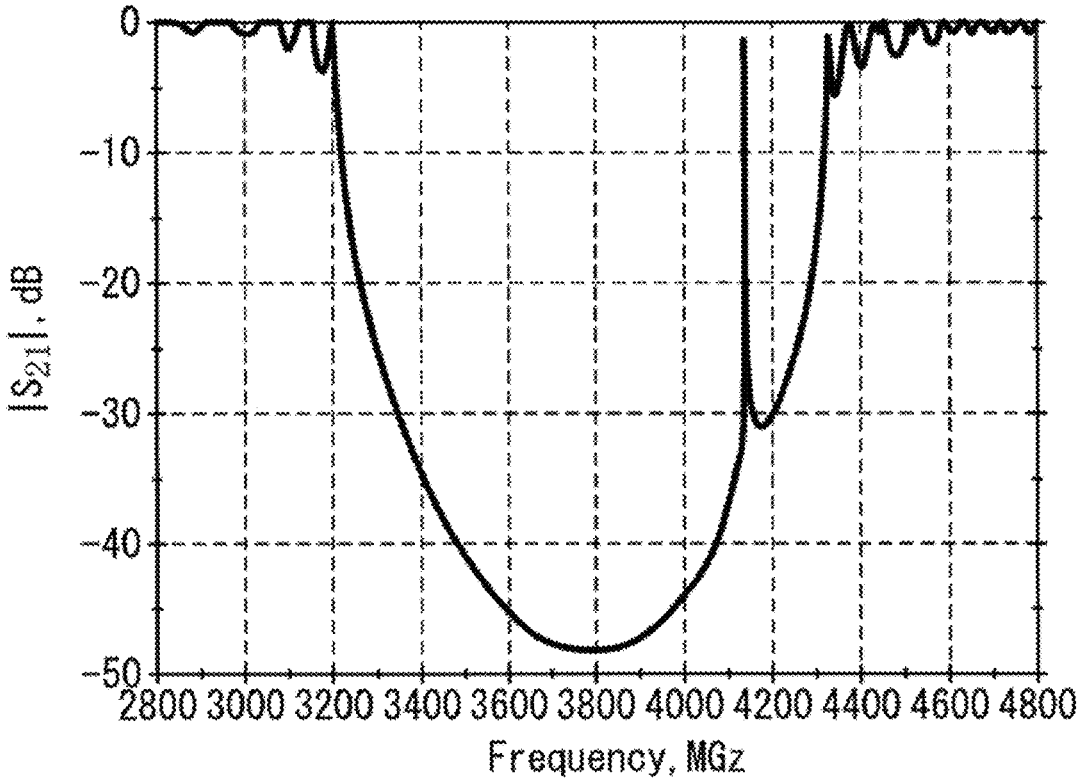
FIG. 7 is a graph showing the $S_{21}$-parameter which demonstrates another position of the narrow pass band within the stop band in the EBG structure with the defect.

In FIG. 6, simulated data obtained for the structure in which dimensions of the periodic cells and the relative permittivity of the substrate isolating material are the same as for FIG. 2. The length of the strip line segment providing the defect in the EBG structure is $L_D$=6.85 mm. As follows from FIG. 6, a high Q pass band at the frequency of about 3.9 GHz is established within the stop band from about 3.2 GHz to about 4.3 GHz. Each assembly of periodic cells formed before the defect and after the defect has been consisted of 5 cells. Thus, the invented EBG structure with defect can be applied to form a filter with a very narrow pass band. It should be noted that that changing the length of the strip line segment providing the defect can be used to control the position of the narrow pass band within the stop band. In FIG. 7, such possibility is shown.

In this case, dimensions on the EBG structure and the material of the multi-layer substrate are the same as for FIG. 6 but the length of the defected strip line segment is $L_D$=6.85 mm. The narrow pass band for this defect in the EBG structure is shifted to the frequency of 4.14 GHz. Thus, a design of a filter with a narrow pass band within the stop band can be carried out by a following procedure. At first, dimensions of transmission line segments and an isolating material of a substrate providing a stop band with a predetermined center frequency can be defined according to the above equations (1) and (3). After that, providing a defect by changing step-by-step the length of a transmission line segment, one can define a desirable position of the narrow pass band within the stop band. It should be noted that a predetermined depth of the stop band can be defined based on the appropriate number of periodic cells including the strip line segments and via-structures.

Figure 8A:
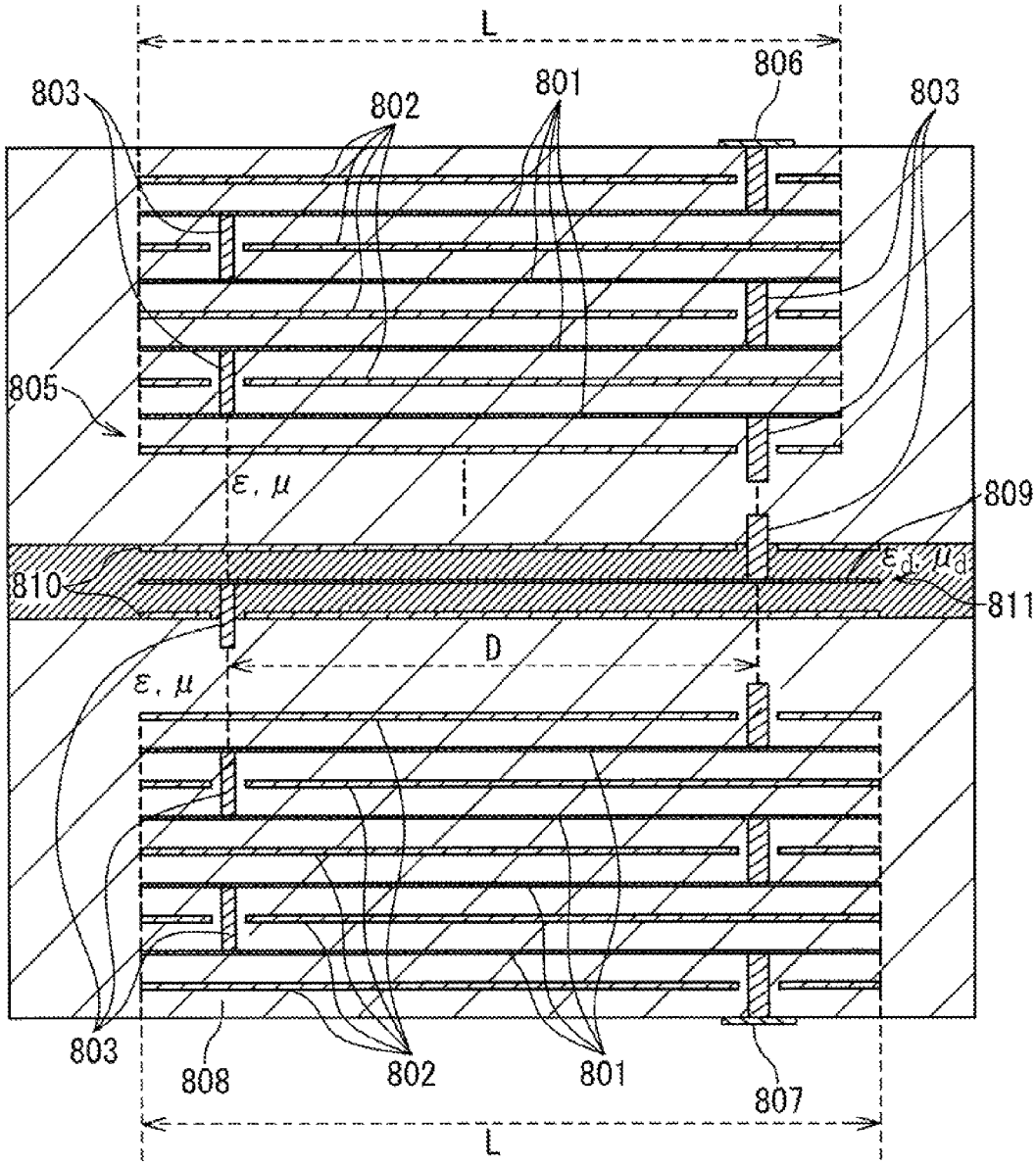
FIG. 8 is cross sectional views showing the filter based on the EBG structure with a defect according to additional embodiments of the present invention.
Figure 8B:
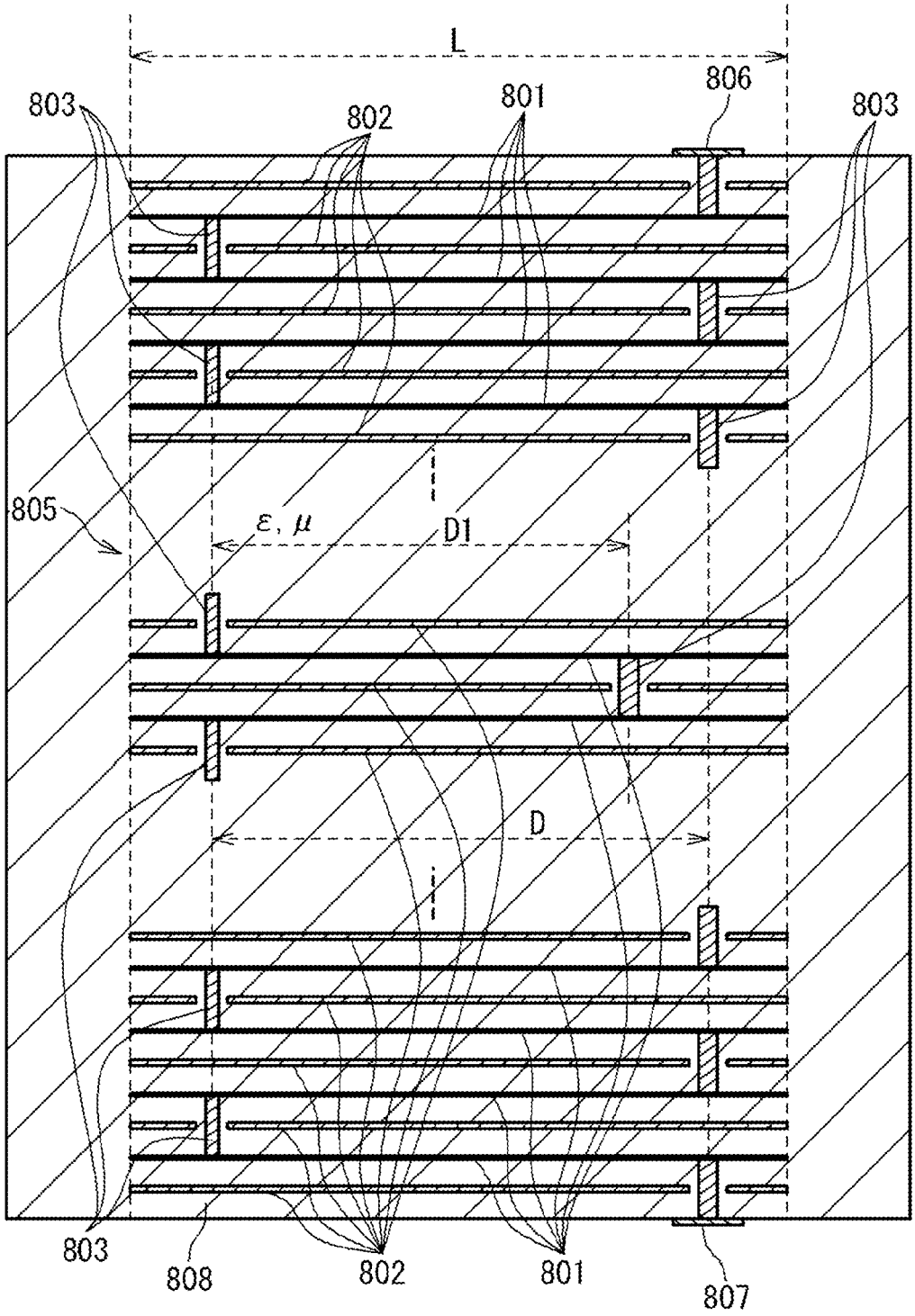
Figure 8C:
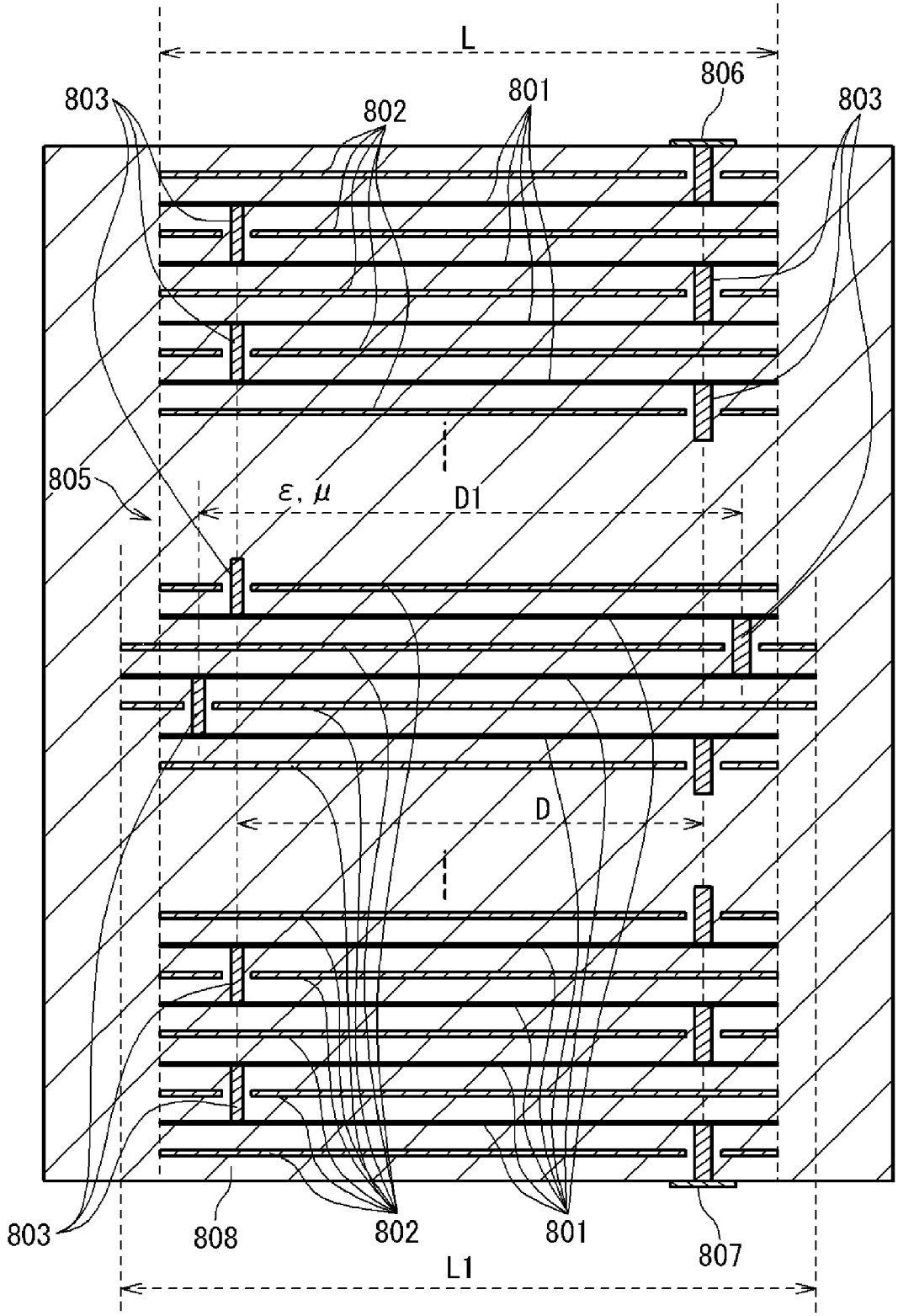

Another method of providing a defect in the EBG structure is the use of a material having the relative permittivity in the one cell differing from the relative permittivity of the material filling the periodic cells. In FIG. 8, an EBG structure with the defect providing according to this method is shown. In this case, the period cells before and after defect in a multi-layer substrate 808 are formed by transmission line segments including ground strips 802 and signal strips 801 connected by via-structures 803, and these transmission line segments forming periodic cells are embedded in an isolating material 805 with constitutive parameters (∈,μ). To provide the defect in the EBG structure, a transmission line segment formed by signal strip 809 and ground strips 810 and filled with an appropriately-chosen material 810 with constitutive parameters (∈α,μα) is used. It should be noted that characteristic impedance of the transmission line forming the defect can be the same as the characteristic impedance of the transmission line forming periodic cells. This impedance equality can be provided by appropriate transverse dimensions of the transmission line forming the defect. To extend a stop band, the EBG structure including a series of EBG configurations having the stop bands with the center frequency differing one from another can be used.

Figure 9:
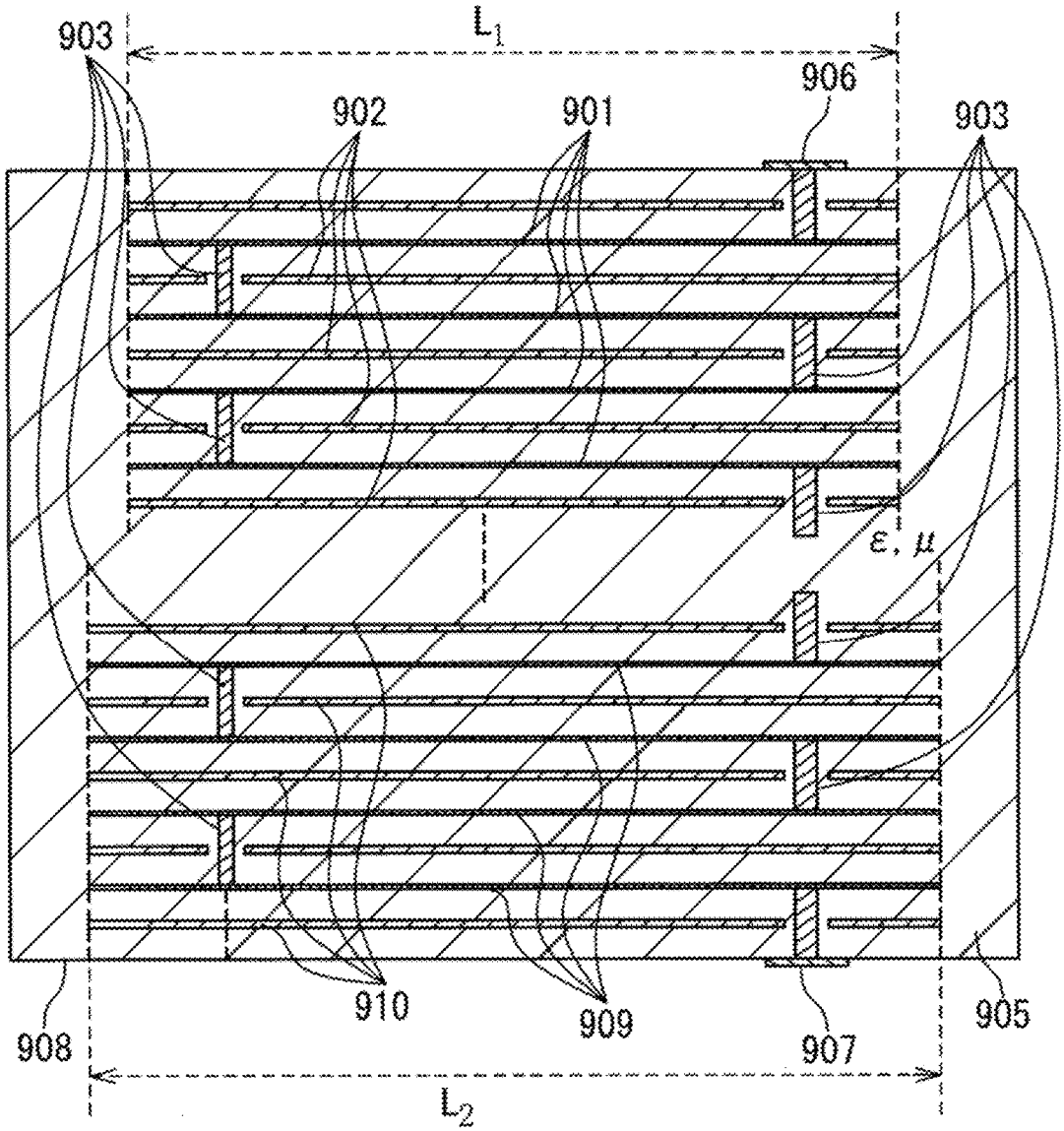
FIG. 9 is a cross sectional view showing the filter based on the EBG structure with extended stop band according to another embodiment of the present invention.

As a method providing a center frequency difference, EBG configurations including transmission line segments of predetermined but different lengths can be applied. An example of EBG structures with the extended stop band is shown in FIG. 9. In this figure, the structure having two EBG configurations is shown. First EBG structure is formed by transmission line segments having signal strips 901 and ground strips 902 and having the length of $L_1$. Another EBG structure is composed of signal strips 909 and ground strips 910 and having the $L_2$ length. These two configuration are formed in a multi-layer substrate 908 filled with a material 905 characterized by (•, •). It should be noted that a predetermined difference between transmission line segments forming the above-mentioned EBG configurations can be obtained by the following way. The length $L_1$ of the first EBG configuration can be approximately defined using the equations 1 and 3 as:

$$L_1 = \frac{c}{2\sqrt{\varepsilon}\, f_{c1}} \tag{4}$$

where $f_{c1}$ is the center frequency of the first EBG structure. The length $L_2$ of the second EBG configuration can respectively defined as:

$$L_2 = \frac{c}{2\sqrt{\varepsilon}\, f_{c2}} \tag{4'}$$

where $f_{c2}$ is the center frequency of the second EBG structure. Therefore, it can be defined that $f_{c2}=f_{c1}\pm$•f. The magnitude of •f can be obtained under the following condition:

$$\Delta f \le \frac{f_{BW1}}{2} \tag{5}$$

where $f_{BN1}$ is the bandwidth of the first stop band taken on the level of −3 dB.

Figure 10:
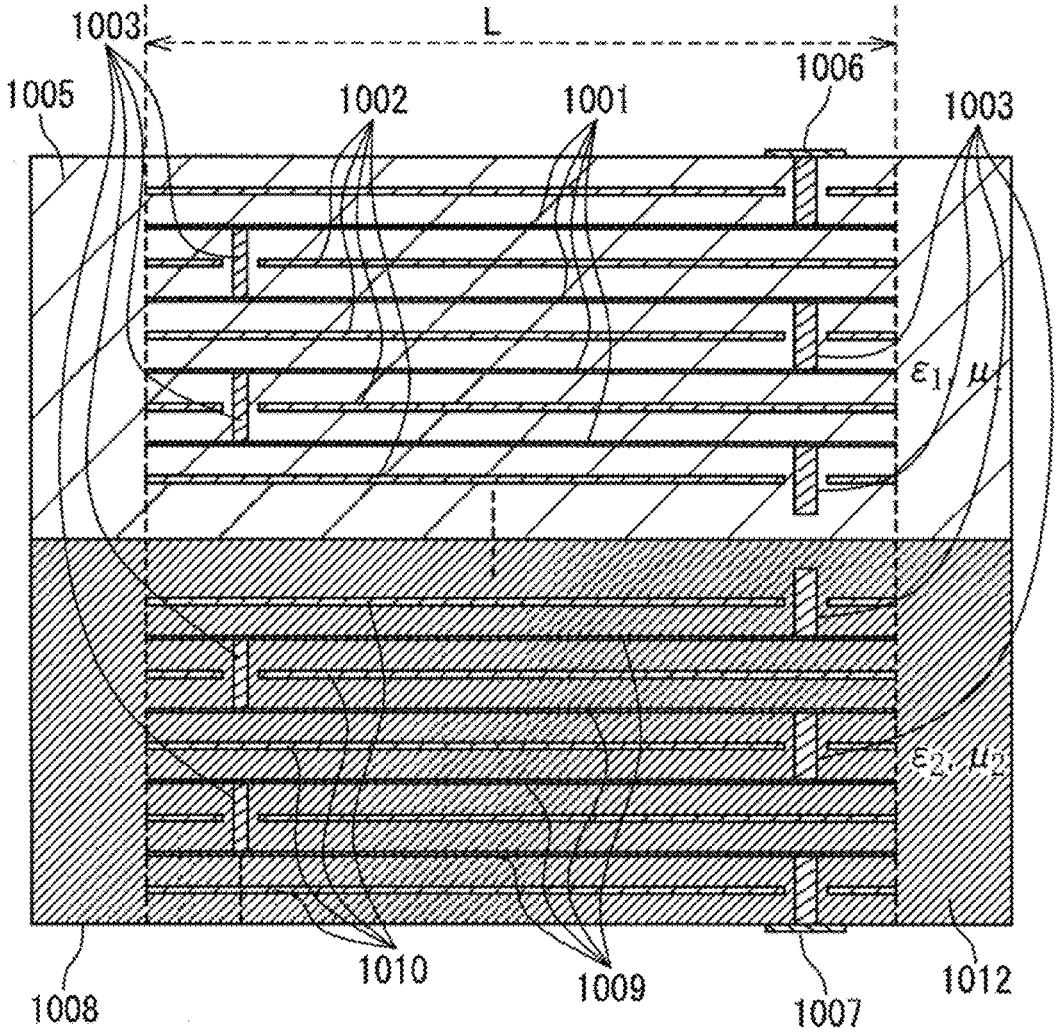
FIG. 10 is a cross sectional view showing the filter based on the EBG structure with extended stop band according to another embodiment of the present invention.

Another method providing an extension of the stop band is the use of EBG configurations formed in a multi-layer substrates and filled with isolating materials having appropriately-defined constitutive parameters. In FIG. 10, an EBG structure including two EBG configurations filled with different isolating materials 1005 and 1012 with ($•_1$, $•_1$) and ($•_2$, $•_2$), respectively, is shown. It should be noted that the characteristic impedances in both EBG configurations can be identical by an appropriate choice of transverse dimensions of transmission lines. Also, it should be added that an extension of a stop band can be provided by a combination of both methods, that is, by use of different lengths of transmission lines segments and different materials in EBG configurations. Also, a number of EBG configurations can provide a predetermined stop band.

Compactness of the EBG structures can be improved by use of a high-permittivity material. One can define such materials as having relative permittivity larger than 9. Also, a low-loss material can be used to design high-performance band pass filters. One of criterions defining a level of the loss can be established for loss tangent as follows tan •• 0.005. For example, Alumina with •'=9.7 and tan •=0.00024 can be related to such high-permittivity low-loss materials.

Figure 11A:
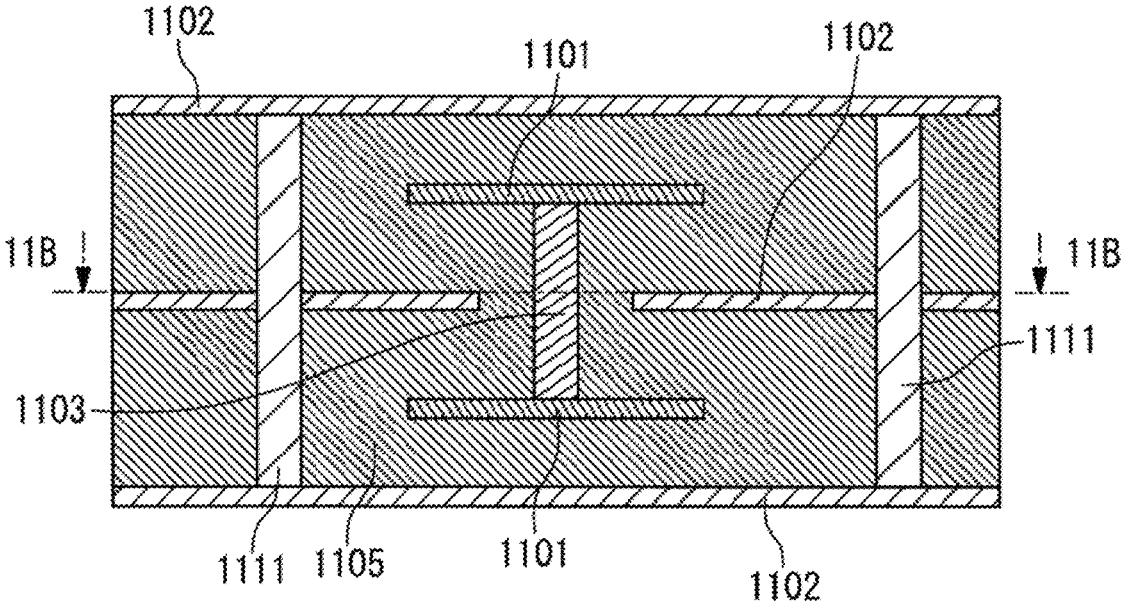
FIG. 11A is a cross sectional view showing two transmission line segments of the EBG structure which are connected by a via structure consisting of signal and ground vias.
Figure 11B:
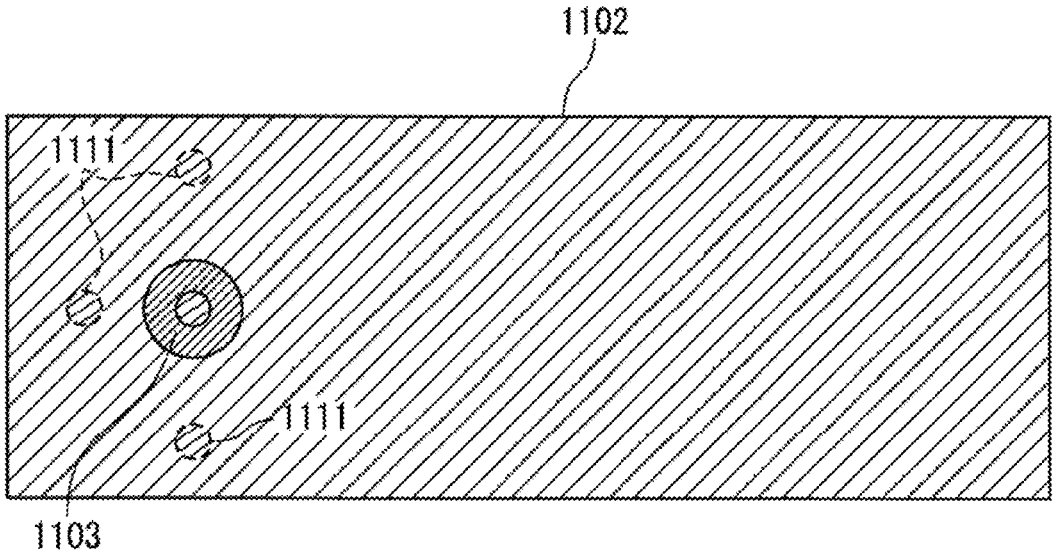
FIG. 11B is a cross sectional view showing a ground strip of the EBG structure formed by transmission line segments and via structures consisting of signal and ground vias.

The via-structure connecting the transmission line segments in the EBG structure can be formed by use of signal and ground vias. In this case, the ground vias serve to control the characteristic impedance $Z_v$ of the via-structure (see FIG. 3) and to reduce leakage from the EBG structure. In FIGS. 11A and 11B, the via-structure connecting two transmission line segments of the EBG structure formed by signal strips 1101 and ground strips 1102 is shown. This via-structures includes a signal via 1103 and ground vias 1111 surrounding the signal via 1103. Thus, the EBG structure can be obtained by use of transmission line segments and via-structures having signal and ground vias.

The invention claimed is:

1. A filter comprising:

a substrate made of an isolating material;

a plurality of identical planar transmission line segments formed one under another by use of conductor layers embedded in said substrate and arranged in a predetermined manner in a direction perpendicular to said conductor layers;

vertical transitions connecting one by one said plurality of transmission line segments, wherein adjacent said vertical transitions are equally spaced on a predetermined distance in a direction parallel to said plurality of transmission line segments, thereby said vertical transitions serve as periodic inclusions providing an electromagnetic band gap effect, and forming conjointly with said plurality of planar transmission line segments of an electromagnetic band gap (EBG) structure; and terminals connected in a predetermined manner to top and bottom ones of said plurality of transmission line segments of said EBG structure, wherein a defect is formed in said EBG structure, thereby providing a pass band within a stop band.

2. The filter according to claim 1, wherein the defect is formed by a planar transmission line structure of said plurality of planar transmission line segments.

3. The filter according to claim 2, wherein the defect is formed by said planar transmission line structure having a predetermined length.

4. The filter according to claim 2, wherein the defect is formed by said planar transmission line structure filled with a predetermined material.

5. The filter according to claim 2, wherein the defect is formed by said planar transmission line structure having a predetermined length and filled with a predetermined material.

* * * * *

UNITED STATES PATENT AND TRADEMARK OFFICE

CERTIFICATE OF CORRECTION

PATENT NO. : 8,378,762 B2
APPLICATION NO. : 12/529382
DATED : February 19, 2013
INVENTOR(S) : Taras Kushta It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 503 days.

Signed and Sealed this
First Day of September, 2015

Michelle K. Lee

Michelle K. Lee
*Director of the United States Patent and Trademark Office*